US007806995B2

(12) United States Patent
Jehanno

(10) Patent No.: US 7,806,995 B2
(45) Date of Patent: Oct. 5, 2010

(54) ODS MOLYBDENUM-SILICON-BORON ALLOY

(75) Inventor: Pascal Jehanno, Höfen (AT)

(73) Assignee: Plansee SE, Reutte/Tirol (AT)

( * ) Notice: Subject to any disclaimer, the term of this patent is extended or adjusted under 35 U.S.C. 154(b) by 303 days.

(21) Appl. No.: 11/384,631

(22) Filed: Mar. 20, 2006

(65) Prior Publication Data

US 2006/0169369 A1 Aug. 3, 2006

Related U.S. Application Data

(63) Continuation of application No. PCT/AT2004/000314, filed on Sep. 15, 2004.

(30) Foreign Application Priority Data

Sep. 19, 2003 (AT) ..... GM640/2003 U

(51) Int. Cl.
*C22C 27/04* (2006.01)

(52) U.S. Cl. ..... 148/423; 420/429

(58) Field of Classification Search ..... 148/423; 420/429

See application file for complete search history.

(56) References Cited

U.S. PATENT DOCUMENTS

| | | | | |
|---|---|---|---|---|
| 4,195,247 | A | | 3/1980 | Hirsch |
| 4,755,712 | A | | 7/1988 | Mujahid et al. |
| 5,595,616 | A | | 1/1997 | Berczik |
| 5,693,156 | A | | 12/1997 | Berczik |
| 5,865,909 | A | | 2/1999 | Meyer et al. |
| 5,868,876 | A | * | 2/1999 | Bianco et al. ..... 148/407 |
| 6,090,227 | A | | 7/2000 | Leichtfried et al. |

FOREIGN PATENT DOCUMENTS

| | | |
|---|---|---|
| EP | 0 275 580 A1 | 7/1988 |
| EP | 0 512 632 A1 | 11/1992 |
| JP | 60 75545 | 4/1985 |
| JP | 60 197839 | 10/1985 |
| WO | WO 96/22402 | 7/1996 |

OTHER PUBLICATIONS

Summers, et al.: "Extrusion and selected engineering properties of Mo-Si-B intermetallics", Intermetallics 8 (2000) 1169-1174, www.elsevier.com/locate/internet, PII:S0966-9798(00)00080-7, Sep. 1, 1999, 6 pgs.

Meyer, et al.: "Isothermal Oxidation Behavior of Mo-Si-B Intermetallics at 1450 ° C", Communication of the American Ceramic Society, vol. 79, No. 10, 1996, pp. 2763-2766.

* cited by examiner

*Primary Examiner*—Roy King
*Assistant Examiner*—Jessee R. Roe
(74) *Attorney, Agent, or Firm*—Laurence A. Greenberg; Werner H. Stemer; Ralph E. Locher

(57) ABSTRACT

A Mo—Si—B alloy has a matrix of Mo or a Mo solid solution, wherein 25% by volume to 90% by volume of molybdenum silicide and molybdenum boron silicide, optionally together with molybdenum boride, are incorporated. The alloy also contains 0.1-5% by volume of one or more oxides or mixed oxides with a vapor pressure at 1500° C. of $<5\times10^{-2}$ bar in finely dispersed form. The oxide addition not only improves the hot strength but also greatly improves the ductility.

5 Claims, No Drawings

ODS MOLYBDENUM-SILICON-BORON ALLOY

CROSS-REFERENCE TO RELATED APPLICATION

This is a continuation, under 35 U.S.C. §120, of copending international application PCT/AT 2004/000314, filed Sep. 15, 2004, which designated the United States; this application also claims the priority, under 35 U.S.C. §119, of Austrian utility model application No. GM 640/2003, filed Sep. 19, 2003; the prior applications are herewith incorporated by reference in their entirety.

BACKGROUND OF THE INVENTION

FIELD OF THE INVENTION

The invention relates to an Mo—Si—B alloy, comprising the intermetallic phases molybdenum silicide and molybdenum boron silicide, optionally together with molybdenum boride, wherein the total content of intermetallic phase constituents amounts to 25 to 90% by volume and the proportion of further microstructural constituents amounts to <5% by volume, and the remainder consists of molybdenum or molybdenum solid solution.

On account of their good mechanical strength properties at high temperatures, molybdenum and molybdenum alloys are in widespread technical use. One problem with these alloys is their low resistance to oxidation at temperatures above approximately 600° C. There is a correspondingly wide range of known measures used to improve the oxidation properties. These range from applying surface protection layers to alloying measures.

U.S. Pat. No. 5,693,156 and Int'l patent application WO 96/22402 (European patent application No. EP 0 804 627) describes an oxidation-resistant molybdenum alloy which consists of a molybdenum matrix and, dispersed therein, intermetallic phase regions comprising 10-70% by volume of Mo—B silicide, optionally up to 20% by volume of Mo boride and optionally up to 20% by volume of Mo silicide. In addition to molybdenum, the alloy comprises the elements C, Ti, Hf, Zr, W, Re, Al, Cr, V, Nb, Ta, B and Si in a form which is such that, in addition to the phases mentioned above, one or more elements selected from the group consisting of Ti, Zr, Hf and Al must be present in the Mo solid solution phase in a proportion of from 0.3-10% by weight. The alloy may optionally contain up to 2.5% by volume of carbide. The alloy can be produced using various processes, preferably by means of powder metallic processes or layer deposition processes. At temperatures over 540° C., alloys as described in the above-mentioned U.S. Pat. No. 5,693,156 and the European patent application EP 0 804 627 form a borosilicate layer which prevents further penetration of oxygen into the interior of the body. The addition of elements such as Ti, Zr, Hf or Al promotes the wetting of the borosilicate layer, increases its melting point and leads to the formation of a high-melting oxide layer beneath the borosilicate layer, which reduces further oxygen transport into the interior.

The addition of carbides leads to an increase in the mechanical strength. One major drawback of alloys of this type is their low fracture toughness. This not only restricts their industrial use but also restricts and causes difficulties for the shaping of components produced therefrom. For example, alloys with a silicon and boron content which are optimum in terms of resistance to oxidation (approx. 4% by weight Si, approx. 1.5% by weight B) can no longer be produced using deformation techniques.

SUMMARY OF THE INVENTION

It is accordingly an object of the invention to provide an oxidation-resistant Mo—Si—B alloy with a high strength which overcomes the above-mentioned disadvantages of the heretofore-known devices and methods of this general type and which, compared to prior art alloys, has an improved fracture toughness and improved deformation properties at temperatures of approx. 1000° C.

With the foregoing and other objects in view there is provided, in accordance with the invention, a Mo—Si—B alloy, comprising:

intermetallic phases molybdenum silicide and molybdenum boron silicide, and an optional component of molybdenum boride, with a total content of intermetallic phase constituents amounting to 25 to 90% by volume and a proportion of further microstructural constituents amounting to less than 5% by volume; an amount of 0.1-5% by volume of one or more oxides or mixed oxides with a vapor pressure at 1500° C. of less than $5\times10^{-2}$ bar; and a remainder of molybdenum or molybdenum solid solution.

In other words, the objects of the invention are achieved with a Mo—Si—B alloy which contains 0.1-5% by volume of one or more oxides or mixed oxides with a vapor pressure at 1500° C. of $<5\times10^{-2}$ bar.

The material according to the invention comprises the intermetallic phases molybdenum silicide and molybdenum boron silicide, optionally together with molybdenum boride, and molybdenum or molybdenum solid solution. Further microstructural constituents are also possible; tests have shown that the content by volume of these further constituents must be <5%. $Mo_3Si$ and $Mo_5SiB_2$ may be mentioned as preferred molybdenum silicide and molybdenum boron silicide phases. Oxides or mixed oxides which have a vapor pressure at 1500° C. of $<5\times10^{-2}$ bar are present in very finely distributed form in this alloy matrix. The preferred mean particle size is <5 μm.

It has been found that additions of oxide to Mo—Si—B alloys not only increase the strength, as is customary with oxide dispersion-strengthened (ODS) alloys, but surprisingly also considerably improve the ductility properties. For example, alloys having the structure according to the invention have an elongation at break which is higher by at least a factor of 3 at 1200° C. than Mo—Si—B alloys according to the prior art with the same silicon and boron contents but without the oxide additions according to the invention. A vapor pressure at 1500° C. of $<5\times10^{-2}$ is required in order to ensure efficient processability. Preferred oxides which may be mentioned in this context include: $Y_2O_3$, $ZrO_2$, $HfO_2$, $TiO_2$, $Al_2O_3$, CaO, MgO and SrO. An effect according to the invention can also be achieved if mixed oxides are used.

Furthermore, the alloy according to the invention may contain elements which form a solid solution with molybdenum. In this context, mention may be made of Re, Ti, Zr, Hf, V, Nb, Ta, Cr and Al. An addition of Nb has proven particularly advantageous in this context. The addition of 5 atomic % of Nb to an Mo—Si—B alloy containing 8.8 atomic % Si and 7.6 atomic % B and 0.5% by volume of yttrium oxide allows the tensile strength at a test temperature of 1000° C. to be increased by 5%, combined at the same time with an increase in the elongation at break of 80%.

The silicon and boron contents should advantageously be selected in such a way that the composition in the molybdenum-silicon-boron three-material system is in the range Mo—$Mo_3Si$-$T_2(Mo_5SiB_2)$—$Mo_2B$. This is the case if the Si content is 0.1-8.9% by weight and the B content is 0.1-5.3% by weight. A concentration range which is particularly advantageous both with regard to strength, creep rupture strength, fracture toughness and oxidation properties is 2-6% by weight Si, 0.5-2% by weight B and 0.2-1% by volume of oxide. If suitable powder metallurgy process techniques are employed, it is ensured that the oxide additions are present in a sufficient fineness and homogeneity in the alloy matrix. In this case, powder mixtures which comprise the corresponding components are treated by mechanical alloying; both elemental powders and prealloyed powders can be used. The equipment used is standard high-energy mills, such as for example attritor mills, ball mills or vibrating mills. To avoid oxidation of the alloying components, it is advantageous for the milling process to be carried out under hydrogen. Hot isostatic pressing has proven a suitable compacting process. In this case, the milled powder is introduced into a container made from an Mo alloy, which is welded shut in a vacuum-tight manner and compacted at temperatures in the range from 1300° C.-1500° C. Other pressure-assisted warm compacting processes, such as for example powder extrusion, can also be used. To refine and homogenize the microstructure, it is advantageous for the compacted body to be subjected to a forming process. This proves particularly favorable if the hot-compacting is effected by pressure-free sintering. In this case, the intermetallic phase fractions, which are in coarse form after the sintering, are comminuted. The oxide additions prevent the intermetallic phase fractions from becoming significantly coarser during the thermomechanical treatment. Moreover, recrystallization, in particular including of the molybdenum-rich phase fractions, is avoided.

In addition to powder metallurgy process techniques, it is in principle also possible to use melt metallurgy production processes. In this context, mention may be made in particular of spray-compacting processes, wherein oxide additions are admixed during the spraying phase.

Other features which are considered as characteristic for the invention are set forth in the appended claims.

Although the invention is illustrated and described herein as embodied in an ODS (oxidation dispersion-strengthened) Mo—Si—B alloy, it is nevertheless not intended to be limited to the details shown, since various modifications and structural changes may be made therein without departing from the spirit of the invention and within the scope and range of equivalents of the claims.

The implementation of the invention, however, together with additional objects and advantages thereof will be best understood from the following description of specific embodiments when read in connection with the following examples.

EXAMPLE 1

0.5% by weight of yttrium oxide powder with a mean grain size determined in accordance with Fisher of 0.8 μm was mixed with 96.5% by weight of Mo with a grain size of 4.12 μm, 3.1% by weight of Si with a grain size of 4.41 μm and 1.14% by weight of B with a grain size of 0.92 μm, followed by mechanical alloying. The mechanical alloying was carried out in an attritor under hydrogen. The attritor volume was 50 l and 100 kg of balls of an Fe—Cr—Ni alloy with a diameter of 9 mm were used. The attrition time was 10 hours. After the mechanical alloying, only molybdenum and $Y_2O_3$ could be detected by means of XRD. The powder was introduced into a container made from an Mo-base alloy. The container was evacuated and welded shut in a vacuum-tight manner. The container and powder were heated in an indirect furnace to a temperature of 1500° C. and densified by extrusion. The extrusion ratio was 1:6. Tensile specimens were machined from the extrudates produced in this way by means of erosion and turning processes. For comparison purposes, a material without yttrium oxide was also produced, using the process steps mentioned above. The specimens according to the invention and the comparison specimens were wherein by a hot tensile test with a strain rate of $10^{-4}$ $sec^{-1}$. The test temperature was gradually increased until it was possible to determine a temperature at which the elongation of the test specimen was at least 10%. In the case of the specimen according to the invention, the temperature determined was 1000° C. In the case of the material without the addition of oxide, this temperature was 1300° C. The corresponding strength values at 1300° C. were 300 MPa for the specimen according to the invention and 200 MPa for the specimen without addition of oxide.

EXAMPLE 2

0.7% by weight of $La(OH)_3$ powder with a mean grain size of 0.2 μm was mixed with 93.9% by weight of Mo with a powder grain size of 4.25 μm, 3.9% by weight of Si with a powder grain size of 4.30 μm and 1.4% by weight of B with a powder grain size of 1.15 μm, and the mixture is then mechanically alloyed. The mechanical alloying was once again carried out in an attritor under hydrogen for a period of 10 hours. The powder was subjected to cold isostatic pressing at 2000 bar and was then densified by a sintering treatment at 1350° C./5 hours under hydrogen. Determination of the density revealed that 91% of the theoretical density (8.7 g/$cm^3$) could be achieved. Since the open porosity was negligible, it was possible to achieve further densification by hot isostatic pressing without the need to use a container. The temperature was in this case 1500° C., the pressure 1980 bar and the HIP time was 4 hours. The density after the hot isostatic pressing was 9.5 g/$cm^3$, which corresponds to 99% of the theoretical density. Specimens produced from this alloy were subjected to an oxidation treatment at 1200° C. The weight measurement was carried out after 1, 3, 10 and 30 hours. These values and values for a material without an oxide addition but having otherwise the same composition and produced in the same way are given in the following table.

| | Weight loss at a test temperature = 1200° C. [mg/$cm^{-2}$] | | | |
|---|---|---|---|---|
| Material | Test time = 1 h | Test time = 3 h | Test time = 10 h | Test time = 30 h |
| Material according to the invention as per Example 2 | 25 | 42 | 45 | 46 |
| Material without oxide addition as per Example 2 | 27 | 50 | 58 | 60 |

I claim:

1. A Mo—Si—B alloy, comprising:

intermetallic phases, molybdenum silicide and molybdenum boron silicide, and an optional component of molybdenum boride, with a total content of intermetallic phase constituents amounting to 25 to 90% by volume and a proportion of further microstructural constituents amounting to less than 5% by volume;

2-6% by weight Si, 0.5-2% by weight B, 0.2-1% by volume of $Y_2O_3$, and a remainder of molybdenum or molybdenum solid solution.

2. The Mo—Si—B alloy according to claim 1, wherein said oxides or mixed oxides have a mean particle size of <5 μm.

3. The Mo—Si—B alloy according to claim 1, wherein a total content of molybdenum silicide and molybdenum boron silicide amounts to 40-80% by volume.

4. The Mo—Si—B alloy according to claim 1, wherein said molybdenum solid solution contains one or more metals selected from the group consisting of Re, Ti, Zr, Hf, V, Nb, Ta, Cr, and Al.

5. A Mo—Si—B alloy, comprising:

intermetallic phases, molybdenum silicide and molybdenum boron silicide, and an optional component of molybdenum boride, with a total content of intermetallic phase constituents amounting to 25 to 90% by volume and a proportion of further microstructural constituents amounting to less than 5% by volume;

2-6% by weight Si, 0.5-2% by weight B, 0.2-1% by volume of $Y_2O_3$, 5-10% by weight Nb, remainder molybdenum.

* * * * *